US005359162A

United States Patent [19]

Bitko

[11] Patent Number: 5,359,162

[45] Date of Patent: Oct. 25, 1994

[54] SHOCK SENSOR SWITCH HAVING A LIQUID CONDUCTOR

[75] Inventor: Sheldon S. Bitko, East Brunswick, N.J.

[73] Assignee: Fifth Dimension Inc., Trenton, N.J.

[21] Appl. No.: 176,685

[22] Filed: Jan. 3, 1994

Related U.S. Application Data

[63] Continuation of Ser. No. 974,518, Nov. 12, 1992, abandoned.

[51] Int. Cl.[5] ..... H01H 35/14

[52] U.S. Cl. ..... 200/226; 200/61.47; 200/229; 200/235

[58] Field of Search ..... 200/226, 227, 228, 231, 200/235, 223, 233, 234, 61.47, 229

[56] References Cited

U.S. PATENT DOCUMENTS

| | | | |
|---|---|---|---|
| 2,311,808 | 2/1943 | Bacon | 200/231 X |
| 2,320,683 | 6/1943 | Trautman | 200/226 X |
| 2,551,520 | 5/1951 | Woodcock et al. | 200/226 |
| 4,099,040 | 7/1978 | Bitko | 200/220 |
| 4,555,697 | 11/1985 | Thackrey | 200/227 X |
| 4,572,934 | 2/1986 | Johnston | 200/227 X |
| 4,683,355 | 7/1987 | Bitko | 200/61.47 |

*Primary Examiner*—Renee S. Luebke

*Attorney, Agent, or Firm*—Burns, Doane, Swecker & Mathis

[57] ABSTRACT

A shock sensor comprises a housing defining an interior space. The space includes a cylindrical side surface and an end surface, the surfaces being formed of an electrically conductive material. An insert is positioned in the space and includes an electrically conductive support surface which defines a recess facing the conductive end surface. A volume of mercury is contained in the recess. The support surface is wetted to the liquid, and the end and side surfaces are not wetted to the liquid, so that the liquid moves into electrical contact with the end surface and/or side surface in response to shocks and is thereafter restored.

9 Claims, 2 Drawing Sheets

SHOCK SENSOR SWITCH HAVING A LIQUID CONDUCTOR

This application is a continuation of application Ser. No. 07/974,518, filed Nov. 12, 1992 and now abandoned.

BACKGROUND OF THE INVENTION

The present invention relates to shock sensors, and more particularly to shock sensors using conductive liquids to complete an electric circuit.

A shock sensor is disclosed in Bitko U.S. Pat. No. 4,683,355 issued to the present inventor on Jul. 28, 1987. One embodiment of that shock sensor is depicted in the accompanying FIG. 1. That shock sensor 10 comprises a housing having a first housing part 12 to the outside of which is connected a first contact terminal 14. The first housing part 12 comprises a non-mercury-wettable, electrically conductive material, such as steel, and is capable of conducting a charge from the terminal 14 to the interior of the first housing part 12.

A mercury-wettable, electrically conductive insert 16 is mounted in electrically conductive engagement with the interior of the housing part 12. Preferred materials for the insert 16 include nickel-copper or nickel-platinum alloys. A thick layer of mercury 18 is placed in contact with a flat mercury-wettable surface of the insert 16.

A second housing part 20 is attached to the first housing part 12. The part 20 comprises a non-mercury-wettable, electrically conductive material, such as steel, and has a central bore therethrough. A nonconductive, non-mercury-wettable core 22, such as glass or an elastomeric material is provided in the bore so as to support a second contact terminal 24 therein. The second contact terminal 24 is arranged such that one end thereof projects into the housing and one end projects out of the housing.

The second housing part 20 is attached to the first housing part 12 by welding or other suitable means. The entire housing is hermetically sealed, and the mercury layer 18 is disposed directly across from the second contact terminal 24. When the shock sensor 10 is at rest, the surface tension of the mercury layer 18 holds the mercury together such that a gap is created between the mercury 18 and the second contact terminal 24. A gas compatible with the mercury 18, such as an inert gas or hydrogen, is provided within the hermetically sealed housing.

The surface tension of a liquid is a force that causes a droplet of the liquid to assume a spherical shape in a zero gravity field. However, the shape and position of a body of liquid which is at rest under conditions of constant pressure and temperature, depend upon the equilibrium of three forces. These forces are (1) the surface tension of the liquid, (2) the magnitude and direction of all forces, including gravity, acting on the liquid, and (3) the degree of wetting between the liquid and any solid surface in contact with the liquid.

The surface tension of mercury is relatively high compared to the surface tension of many other liquids. The relatively high surface tension allows a large quantity of mercury to adhere to a surface to which it is wetted. Accordingly, it will be appreciated that gravitational forces combine with surface tension to cause the mercury 18 to collect toward the center of the insert 16, which is arranged directly below the second contact terminal 24.

A surface is considered to be wetted with a liquid if the liquid forms a low contact angle with the surface. A small quantity of liquid on a non-wetted surface will tend to bead, while on a wetted surface, the liquid will tend to spread itself uniformly over the wetted surface. In addition, as a result of an impact, the liquid will leave a non-wetted surface without generating any restoring surface tension forces, whereas resisting forces will be present in the case of a liquid wetted to a surface.

It will be appreciated that if the shock sensor 10 is subjected to a longitudinally directed shock, such as for example a sudden impact or abrupt deceleration, the mercury 18 will be subjected to a longitudinal force, e.g., force A in FIG. 1, and thus will be displaced toward the contact 24. The combined effects of: Force A, gravity, and the surface tension of the mercury cause the mercury to redistribute and protrude from the insert 16. If the Force A is greater than a predetermined value, the mercury 18 will protrude sufficiently to contact the second contact terminal 24.

When the mercury 18 contacts the tip of the second contact terminal 24, the surface tension of the contacting mercury 18 will cause the mercury 18 to stay temporarily in electrical contact with the second contact terminal 24, even though the center of gravity of the mercury 18 may tend to oscillate for a brief period, thus avoiding contact bounce problems. When the mercury 18 contacts the second contact terminal 24, a circuit is completed between the first and second contact terminals 14, 24 by means of the housing 12, the insert 16, and the mercury 18.

After the shock is over, the surface tension of the mercury 18 restores the mercury 18 back to its original configuration, thus breaking the circuit between the contact terminals 14, 24.

On the other hand, if the shock is directed sideways, i.e., toward the left or right hand side in FIG. 1, then it is necessary for the mercury to rebound off the side surface 13 of the container in order to reach the contact terminal 24. In order for that to occur, it is necessary that the minimal sideways force for closing the switch be stronger than the minimal longitudinal force A for closing the switch. This is also true in the case of a Force A′ directed at an acute angle relative to Force A, because the mercury may be displaced somewhat laterally relative to the contact terminal and thus fail to make contact therewith unless it rebounds off the side surface 13. Hence, to provide a sensing system which is multi-directionally sensitive for a particular shock level, it would be necessary to provide a large multitude of sensors.

Also, the sensor 1 depicted in FIG. 1 forms a cavity 15 in which mercury can become caught and separated from the main mercury volume, thereby adversely affecting the behavior of the sensor.

Moreover, for the reasons discussed above, the FIG. 1 shock sensor would not be very sensitive to centrifugal force caused by rotation of the sensor along its longitudinal axis, i.e., an axis coinciding with Force A in FIG. 1.

Therefore, it would be desirable to provide a shock sensor which is sensitive in a wider variety of directions to a given shock value, and also to provide such a shock sensor which is more sensitive to centrifugal force.

From the foregoing description, it will be appreciated that the sensor 10 is most sensitive to shocks applied in the direction of Force A, since the shock magnitude required to close the switch is smallest in that direction. It would further be desirable to increase the sensitivity of the sensor so that it will close in response to weaker shocks than will the sensor 10 of FIG. 1.

SUMMARY OF THE INVENTION

The present invention relates to a shock sensor for comprising a housing which defines an interior space. The housing forms an interior end surface situated at one end of the space, and a cylindrical side surface extending from that end surface. The end and side surfaces are electrically conductive and are connected to a first contact terminal. An electrically insulative mass is disposed at an end of the space opposite the end surface. An insert is supported by the mass and includes a support surface defining a recess which faces the end surface. The support surface is electrically conductive and is connected to a second contact terminal. A volume of electrically conductive liquid (such as mercury) is contained in the recess. The support surface is wetted to the liquid, and the end and side surfaces are non-wetted to the liquid, so that the liquid moves into electrical contact with the end surface and/or side surface in response to shocks and is thereafter restored.

The housing preferably comprises first and second housing parts which are secured together. The mass of the electrically insulative material is disposed in the first housing part, and the second housing part forms the end surface, and the first housing part forms the side surface. The first and second housing parts are formed of an electrically conductive material and are joined in an electrically conductive manner.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 2:
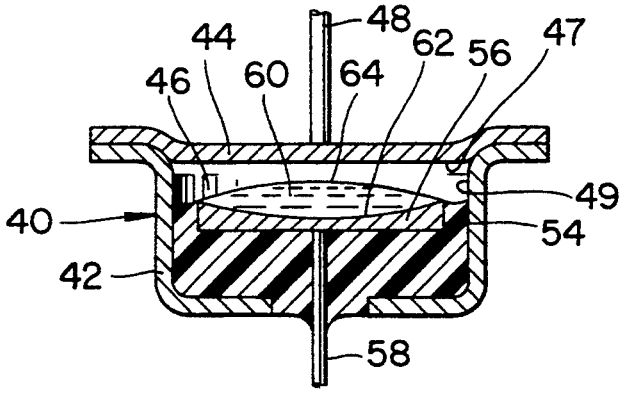
FIG. 2 is a sectional view taken through a shock sensor according to the present invention in a steady state.
Figure 3:
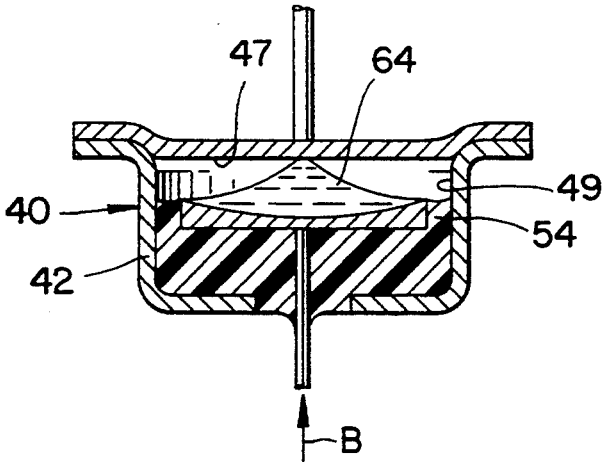
FIG. 3 is a view similar to FIG. 2 depicting the shock sensor subjected to a shock.

A shock sensor 40 depicted in FIGS. 2 and 3 comprises a housing having a cup-shaped container part 42 formed of an electrically conductive, mercury non-wettable material such as steel. The housing also includes a cover part 44 affixed to one end of the container part 42 to be in electrically conductive relationship therewith and encloses a cylindrical interior space 46 formed therebetween. That space 46 is hermetically sealed and contains a gas which is compatible with mercury, such as an inert gas or hydrogen. The cover part 44 comprises a non-mercury-wettable, electrically conductive material, such as steel, to which a first contact terminal 48 is connected. The cover part 44 is affixed to the housing 42 in any suitable manner, such as by welding and forms an interior end surface 47 of the space 46. A cylindrical interior side surface 49 of the space 46 is formed by the container part 42. That side surface 49 contacts the end surface 47.

Figure 5:
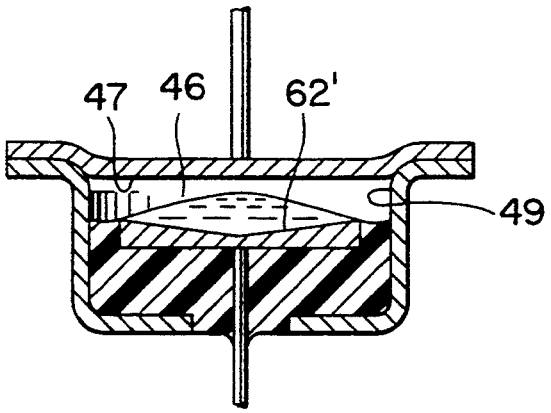
FIG. 5 is a view similar to FIG. 2 of another embodiment of the invention.

A non-conductive, non-mercury-wettable mass 54, such as glass or an elastomeric material, is provided in the housing to support an insert 56. A second contact terminal 58 extends through the mass 54 and is connected to the insert 56. The insert 56 comprises an electrically conductive body which forms a recess 60 situated opposite the cover 44. That recess is defined by a support surface 62 of the insert which can be of various recess-defining shapes, such as for example a segment of a sphere, as shown in FIG. 2, or a cone 62' as shown in FIG. 5. Other recess shapes will be readily apparent to those skilled in the art.

The insert 56 is formed of an electrically conductive material which has a coefficient of thermal expansion close to that of the insulative mass 54, and which can be sealed to the mass without generating appreciable stress. In the case of a mass 54 formed of glass, the insert could be formed of a nickel-iron-cobalt alloy such as Kovar ®. The support surface 62 must be wetted to the mercury. In the case of a Kovar insert, the surface 62 could be made mercury-wettable by any suitable conventional technique, such as nickel or copper plating.

The mercury wettable and electrically conductive surface 62 (or 62') carries a volume 64 of mercury or other suitable electrically conductive liquid. The mercury is susceptible to gravity and other forces. In a steady state, i.e., with no shocks acting on the mercury, the mercury volume is thickest at the center of the surface 62. Due to the fact that the surface 62 forms a recess, a greater volume of mercury can be provided than would otherwise be the case if the surface 62 were a flat surface as described earlier in connection with FIG. 1. Thus, the sensor is more sensitive to weaker shocks.

Within the context of the present invention, the term "shock" includes all external forces applied to the sensor (except gravity), including acceleration, deceleration, impacts, jolts, vibrations, etc.

If the shock sensor were subjected to a shock in the direction B (FIG. 3), e.g., a sudden deceleration occurring when the sensor is traveling in the direction B, the mercury 64 would protrude toward the surface 47. The combined effects of the shock, gravity, and the surface tension of the mercury determine the extent to which the mercury projects. If contact with the surface 47 is made, then the contact terminals 48, 58 are electrically interconnected.

Figure 1:
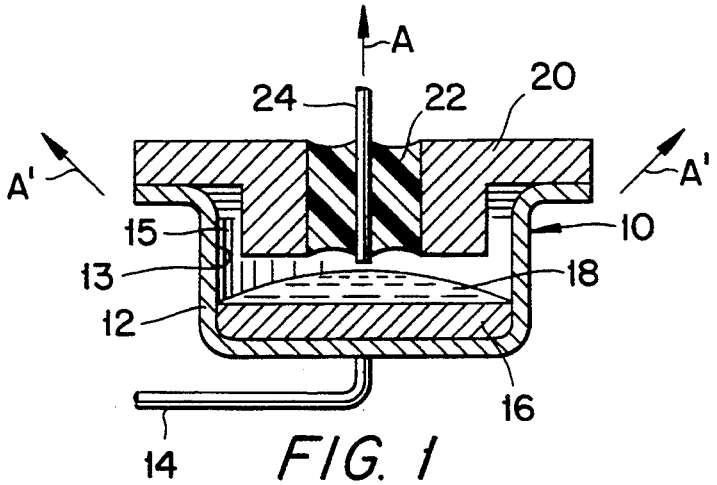
FIG. 1 (PRIOR ART)
FIG. 1 is a cross-sectional view taken through a shock sensor according to the prior art.

Since the surface 47 extends across the entire cross section of the space 46, a much larger target area for the mercury is presented as compared to the switch of FIG. 1 in which the narrow contact terminal 24 defines the entire target area. This is significant, because shock directed at an acute angle relative to the central axis CA of the sensor may cause the mercury to protrude in a laterally off-center direction as shown in connection with the sensor 50B depicted in FIG. 4. Note in that figure that a shock D causes the mercury 64' to engage the surface 47 at a location laterally spaced from the central axis CA. If that shock had been applied to a sensor constructed in accordance with FIG. 1, no electrical connection would have been made.

Therefore, the sensor 40 is highly multi-directionally sensitive for a given shock magnitude such that, for the most part, only shocks directed opposite the direction B (FIG. 3) would fail to close the switch at that given shock magnitude. However, a sensing system using the present sensor technology could be made omni-directional for a given shock magnitude by arranging two sensors 40 such that their center axes CA are arranged at a right angle to one another (e.g., see the arrangement of two sensors 50A, 50B in FIG. 4).

Figure 4:
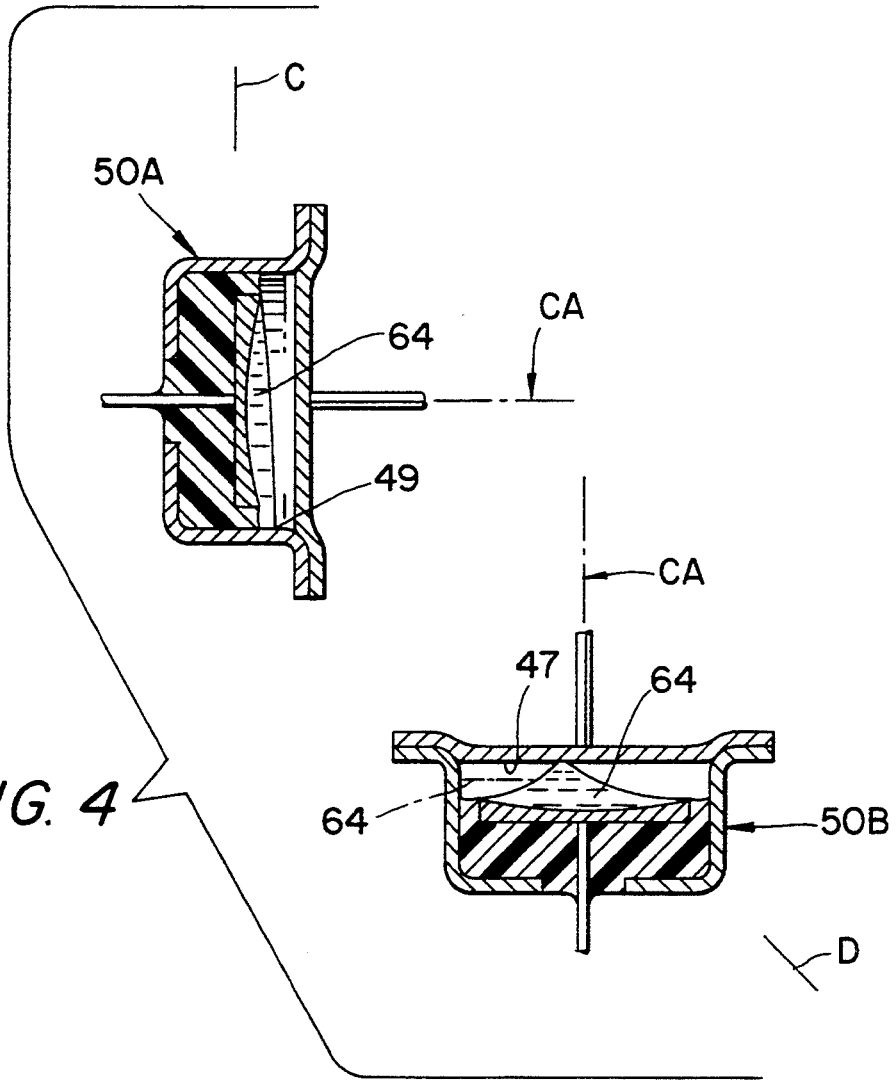
FIG. 4 is a sectional view through a pair of shock sensors according to the present invention, wherein the shock sensors are subjected to shocks in various directions.

It will be appreciated that for a given shock magnitude, the sensor 50A will be sensitive in virtually all directions, except in a direction toward the left in FIG. 4, and the sensor 50B will be sensitive in virtually all directions, except in a direction directed downwardly (i.e., direction C). Accordingly, omni-directional sensitivity for a given shock magnitude will be provided by both sensors acting together. Note that for a shock directed to the left, the mercury in sensor 50B will project to the left and contact the side wall 49 as shown in broken lines in FIG. 4. Likewise, in the case of a shock in direction C, the mercury in sensor 50A will project downwardly into contact with the wall 49.

Since the end and side surfaces 47, 49 abut one another, no cavity similar to the cavity 15 of FIG. 1 is formed in which the mercury could become entrapped. It is preferable that the total volume of the space 46 is such that some of the mercury will always contact the wetted surface 62 and thus will always be restored to the recess, rather than becoming separated therefrom. For example, the total volume of space 46 could be less than two times the volume of mercury.

Furthermore, the sensor is sensitive to centrifugal force created when the sensor rotates about the axis CA, because the mercury will spread-out radially outwardly into contact with the side wall 49.

The sensor can be made very small, e.g., on the order of about ⅜ in. in diameter and ⅜ in. in length.

It will be appreciated that the present invention enables a greater volume of mercury to be provided without increasing the size of the sensor. Thus, the sensor is more sensitive to weaker shocks. Also, since the mercury has a relatively wide target area (i.e., the surface 47 and 49) to engage in response to a shock, the directional sensitivity of the sensor is enhanced. Thus, only two sensors can provide omni-directional sensitivity per given shock level. Also, the sensor is sensitive to centrifugal shock.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A shock sensor for sensing shock, comprising:

a housing defining an interior space, said housing forming an interior end surface situated at one end of said space, and a cylindrical side surface extending from said end surface, said end and side surfaces being electrically conductive and connected to a first contact terminal, an electrically insulative mass disposed at an end of said space, an insert supported by said mass and including a support surface defining a recess facing said interior end surface, said support surface being electrically conductive and connected to a second contact terminal, and a volume of electrically conductive liquid contained in said recess, said support surface being wetted to said liquid, and said end and side surfaces being non-wetted to said liquid so that in an absence of shock the liquid is situated in said recess and out of electrical contact with said end and side surfaces regardless of the orientation of said housing relative to vertical, and so that said liquid moves into electrical contact with said end surface and/or side surface in response to shock and is restored to said recess when the shock subsides.

2. A shock sensor according to claim 1, wherein said housing comprises first and second housing parts secured together, said mass of electrically insulative material disposed in said first housing part, said second housing part forming said end surface, and said first housing part forming said side surface.

3. A shock sensor according to claim 2, wherein said first and second housing parts are formed of an electrically conductive material and are joined in an electrically conductive manner.

4. A shock sensor according to claim 1, wherein said end surface extends across substantially an entire cross section of said one end of said space.

5. A shock sensor according to claim 1, wherein said support surface is shaped as a segment of a sphere.

6. A shock sensor according to claim 1, wherein said support surface is of conical shape.

7. A shock sensor according to claim 1, wherein said mass of insulative material is glass.

8. A shock sensor according to claim 1, wherein said electrically conductive liquid is mercury.

9. A shock sensor for sensing shock, comprising:

a housing defining an interior space, said housing including first and second housing parts secured together, said housing parts being electrically conductive, said second housing part forming an interior end surface of said space situated at one end of said space and extending across substantially an entire cross section of said one end of said space, said second housing part forming an interior cylindrical side surface of said space which extends from said end surface, said housing being connected to a first contact terminal, an electrically insulative mass disposed in said second housing part, an insert supported by said mass and including a support surface defining a recess facing said end surface, said insert being electrically conductive and connected to a second contact terminal, and a volume of electrically conductive liquid contained in said recess, said support surface being wetted to said liquid, and said end and side surfaces being non-wetted to said liquid so that in an absence of shock the liquid is situated in said recess and out of electrical contact with said end and side surfaces regardless of the position of said housing relative to vertical, and so that said liquid moves into electrical contact with said end surface and/or said side surface in response to shock and is restored to said recess when the shock subsides.

* * * * *